US007381067B2

(12) United States Patent
Sze

(10) Patent No.: US 7,381,067 B2
(45) Date of Patent: Jun. 3, 2008

(54) 4 IN 1 TRAVEL ADAPTOR

(76) Inventor: Hug To Honton Sze, 108, Kam Wai House, Kam Fung Court, Ma On Shan, Hong Kong (HK)

( * ) Notice: Subject to any disclaimer, the term of this patent is extended or adjusted under 35 U.S.C. 154(b) by 0 days.

(21) Appl. No.: 11/750,939

(22) Filed: May 18, 2007

(65) Prior Publication Data

US 2007/0293072 A1 Dec. 20, 2007

Related U.S. Application Data

(63) Continuation-in-part of application No. PCT/CN2006/000489, filed on Mar. 24, 2006.

(30) Foreign Application Priority Data

Apr. 28, 2005 (CN) ..... 2005 2 0057917

(51) Int. Cl.
*H01R 13/44* (2006.01)

(52) U.S. Cl. ..... 439/131; 439/166

(58) Field of Classification Search ..... 439/166, 439/170, 171, 131, 135, 13, 137, 106
See application file for complete search history.

(56) References Cited

U.S. PATENT DOCUMENTS 4,386,333 A * 5/1983 Dillan ..... 439/173
5,429,516 A * 7/1995 d'Alayer de Costemore d'Arc ..... 439/651
6,328,581 B1 * 12/2001 Lee et al. ..... 439/106
7,168,969 B1 * 1/2007 Wang ..... 439/173
7,273,384 B1 * 9/2007 So ..... 439/172

FOREIGN PATENT DOCUMENTS

CN 2237894 Y 10/1996

* cited by examiner

*Primary Examiner*—Briggitte R. Hammond
(74) *Attorney, Agent, or Firm*—J.C. Patents

(57) ABSTRACT

The present invention relates to a versatile travel adaptor, comprising: a cylindrical base member which is provided with a plurality of fixed shafts and a plurality of socket arrays; a dial member rotatably mounted around the base member and provided with a projection; a plurality of inner plugs each of which is movably mounted above the top end of the base member and guided by the respective fixed shafts; and an upper cover covering the inner plugs and provided with a plurality of plughole arrays therethrough; wherein the socket arrays are provided with conductive sheets electrically connected to the inner plugs and are used to receive outer plugs to be converted, each of the inner plugs has a protrusion, and the dial member could be rotated to select one of said inner plugs at a time and move the selected inner plug upward to its operation position through the respective plughole array by mean of contact between the protrusion of the selected inner plug and the projection of the dial member.

18 Claims, 8 Drawing Sheets

4 IN 1 TRAVEL ADAPTOR

CROSS-REFERENCE TO RELATED APPLICATION

This application is a continuation-in-part of International Application No. PCT/CN2006/000489 filed on Mar. 24, 2006, which in turn claims the priority benefit of China application No. 200520057917.1 filed on Apr. 28, 2005.

FIELD OF THE INVENTION

The present invention relates to connecting means of a power supply of an electrical installation, particularly to a versatile travel adaptor, which could be used in different regions and under different service.

BACKGROUND OF THE INVENTION

Currently, there are just several kinds of travel adaptors:

1. Single-use adaptor: when in an outgoing travel, the user must know the specification of the local power supply adaptors; otherwise he had to bring all kinds of the different adaptors, which would cause inconvenience.

2. Combined adaptor: before combination, the metal for electrifying often reveals to the outside, if the plug is inserted in the socket by incaution, there is a danger of being shocked. Further, lose of a component is likely to occur to a combined adaptor.

3. Versatile adaptor: such adaptors do not have the disadvantages of the single-use adaptor and the combined adaptor, but use of versatile adaptors is complicated, and the security is also problematic.

Therefore, above-mentioned travel adaptors have disadvantages of too much components, complication in use and inconvenience in operation, and hence cannot gratify the need of different countries, different regions and different service patterns.

SUMMARY OF THE INVENTION

An object of the present invention is to provide an integrative versatile travel adaptor, which could be used in different regions and under different service patterns. The versatile travel adaptor comprises: a cylindrical base member which is provided with a plurality of fixed shafts extending upward from the top end thereof and a plurality of socket arrays formed on the bottom end thereof; a dial member which is rotatably mounted around the base member and provided with a projection extending upward between the dial member and the peripheral of the base member; a plurality of inner plugs each of which is movably mounted above the top end of the base member and guided by the respective fixed shafts to be moved up and down along the fixed shaft; and an upper cover which covers the inner plugs and is provided with a plurality of plughole arrays therethrough; wherein the socket arrays are provided with conductive sheets electrically connected to the inner plugs and are used to receive outer plugs to be converted, each of the inner plugs has a protrusion laterally extending to interfere with the projection of the dial member, and the dial member could be rotated to select one of said inner plugs at a time and move the selected inner plug upward to its operation position through the respective plughole array by mean of contact between the protrusion of the selected inner plug and the projection of the dial member.

The present invention has following advantages:

1. The operation of the travel adaptor of the present invention is simple. The needed plug could be chosen and pushed out by just rotating the dial member.

2. The adaptor of the present invention is of convenience and portability. Four kinds of plugs with different specifications are included, which renders it usable in most of the countries and regions.

3. The adaptor of the present invention is of high safety. Only one kind of plug would be pushed out at a time, and the other plugs and metal components would not come out, which avoid the risk of being shocked.

DETAILED DESCRIPTION OF THE INVENTION

Reference will now be made in detail to the preferred embodiments of the invention, which is illustrated in the accompanying figures.

Figure 1:
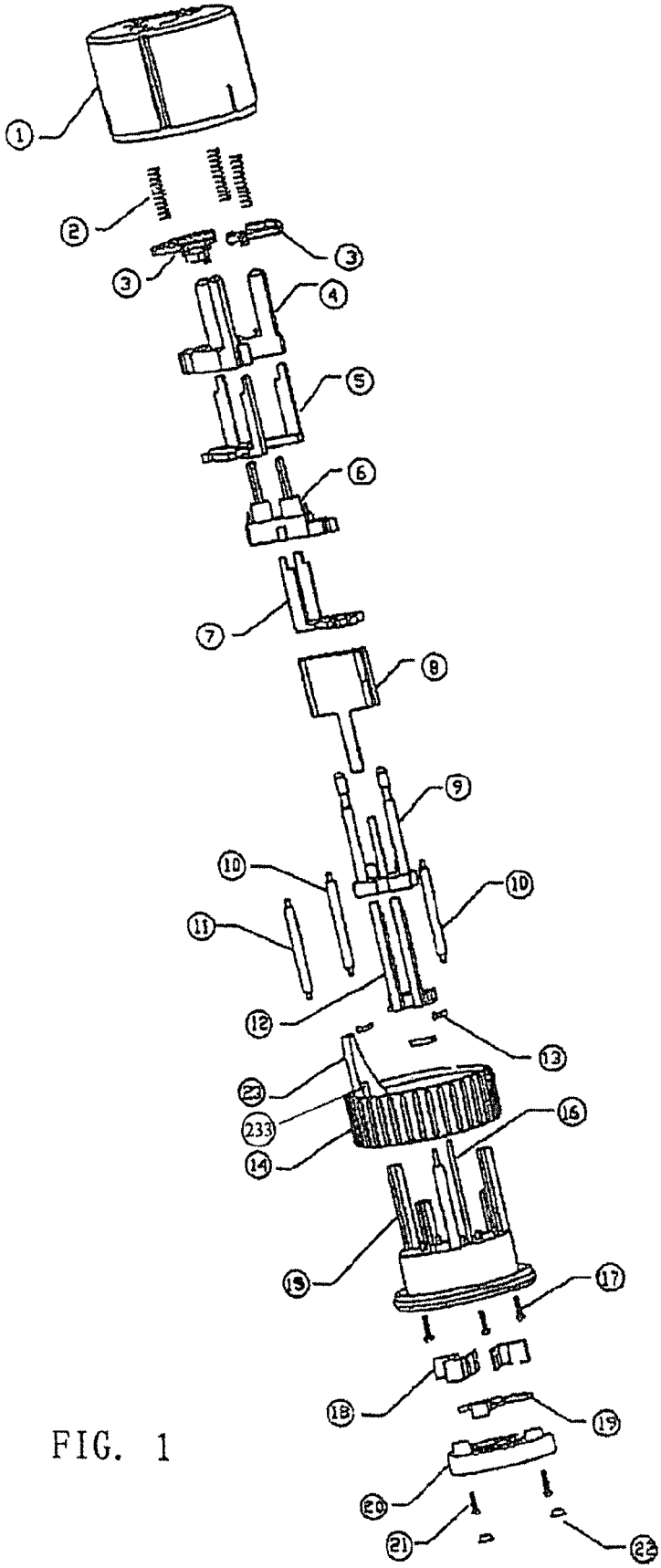
FIG. 1 shows an exploded perspective view of the travel adaptor of the present invention.
Figure 2:
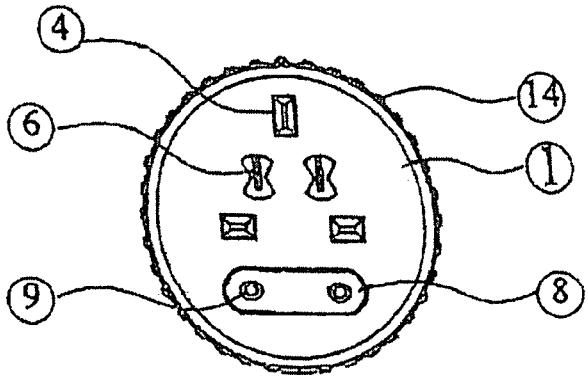
FIG. 2 shows a top view of the travel adaptor of the present invention, with an inner plug being rotated out.
Figure 5:
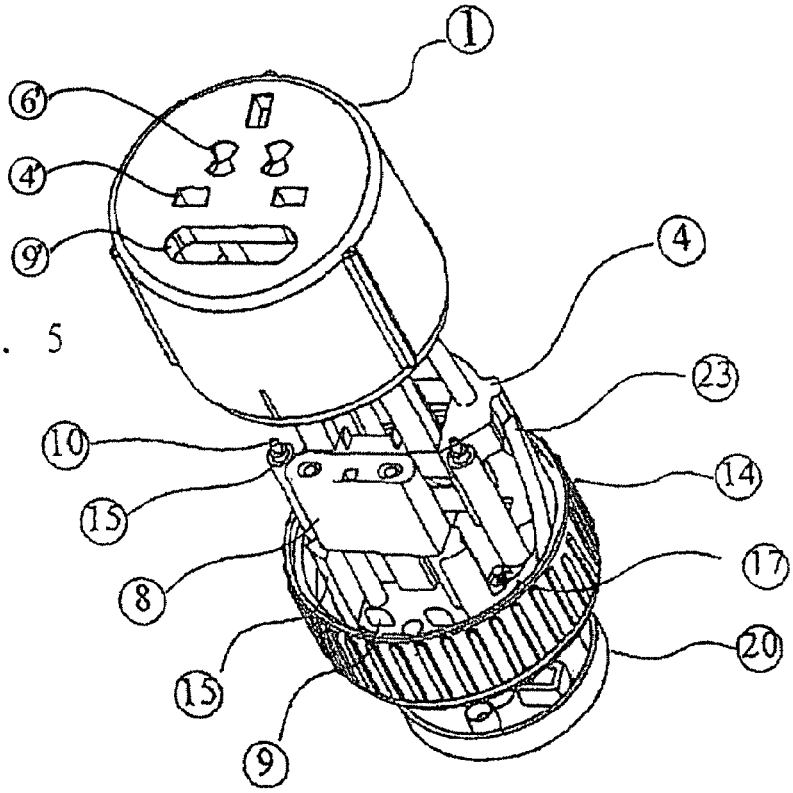
FIG. 5 shows a perspective view of the travel adaptor of the present invention, with the upper cover and the lower cover opened.

FIGS. 1-5 show a versatile travel adaptor which is particularly suitable for be used in different regions and under different service patterns. As shown in FIGS. 1 and 5, the versatile travel adaptor comprises a cylindrical base member 15, a dial member 14, a plurality of inner plugs and an upper cover 1. Hereinafter, the structures of those members are described by way of example.

In FIG. 1, the cylindrical base member 15 is provided with a plurality of fixed shafts 16 extending upward from the top end thereof and a plurality of socket arrays 24 (see FIG. 4) formed in the bottom end thereof. The socket arrays 24 are provided with conductive sheets 18 and 19 therein, and are used to receive outer plugs (not shown) to be converted. The conductive sheets 18, 19 could be electrically connected to the inner plugs in any manners know in the prior art.

As a preferred embodiment of the present invention, the conductive sheets 18, 19 could be connected to the inner plugs by the combination of conductive poles 10, 11 and conductive metal sheets 3. As shown in FIG. 1, the conductive poles 10 and 11 are inserted into the top end of the base member 15, thus the bottom ends of the conductive poles electrically connect to the conductive sheets. The conductive poles 10 and 11 could be fixed to the base member 15 by screws 17 screwed into the base member 15 from below. At the top ends of the conductive poles, the conductive metal sheets 3 are mounted in such a manner as to electrical contact one inner plug at a time when the inner plug has been moved pushed to its operation position.

The dial member 14 is rotatably mounted around the base member 15, and is provided with a projection 23 extending upwards between the dial member and the peripheral of the base member.

Figure 20:
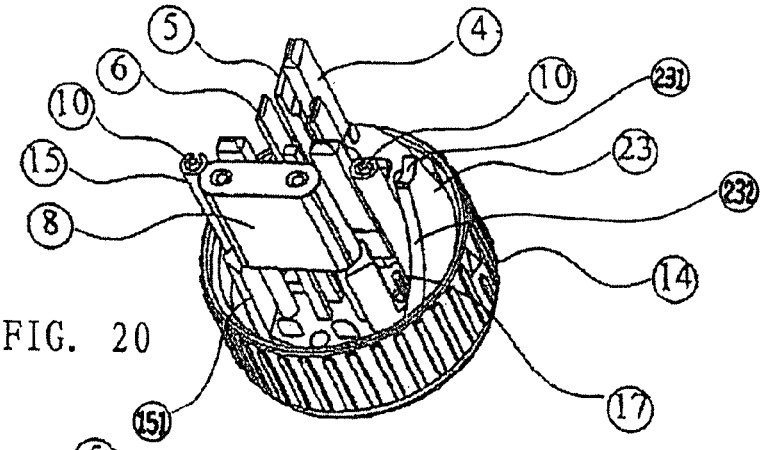
FIG. 20 is a perspective view illustrating the connection between the base member, the dial member and each inner plug of the present invention.

As shown in FIG. 20, there is a slope 232 on each side of the projection 23 along the peripheral of the cylindrical base member 15. Alternatively, the slope 232 could only be formed on one side of the projection 23. The slope is formed to make the projection narrower from the bottom to the top. A groove 231 could be formed at the tip of the projection 23. At the middle portion of the lower part of the projection 23, a recess 233 (see FIG. 1) is formed into the inner surface of the projection 23 facing to the base member 15.

Figure 22:
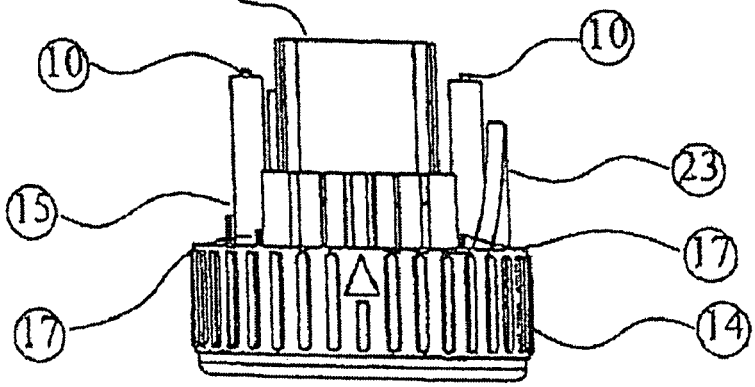

As shown in FIG. 22, the dial member 14 may have a mark formed on the outside surface thereof, to indicate the rotation position of the dial member 14 around the base member 15.

Each of the inner plugs is movably mounted above the top end of the base member 15 and guided by the respective fixed shaft 16. The plurality of inner plugs could be any of British plug, 1-shape plug and European plug, or any combinations of those plugs. As an example, the embodiment of the present invention shows a combination of a British plug 4, a 1-shape plug 6 and a European plug 9.

The adaptor may also comprise a plurality of plug carriages movably mounted on the top end of base member 15. The plug carriages correspond to the inner plugs and could support the respective inner plugs when the inner plugs are in their operation position. As an example, the plug carriages are combination of a British plug carriage 5, a 1-shape plug carriage 7 and a European plug carriage 12, as shown in the accompanying figures.

Guided by their respective fixed shafts 16, the British plug 4, 1-shape plug 6 and European plug 9 are seated respectively on the British plug carriage 5, 1-shape plug carriage 7 and European plug carriage 12. Springs 2 are mounted around the fixed shafts 16 between the upper cover 1 and each of the British plug 4, 1-shape plug 6 and European plug 9. The springs could apply bias pressure onto the respective plugs, to make the respective plugs in a tendency of moving towards the base member 15.

With reference to FIGS. 11-16, the structures of the inner plugs and plug carriages will be described in detail in the following.

Figure 11:
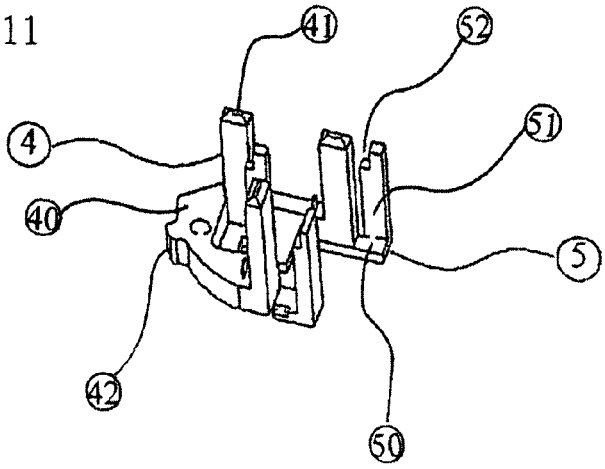
FIG. 11 is a perspective view of the British plug and its carriage of the present invention, showing the initial state thereof.
Figure 12:
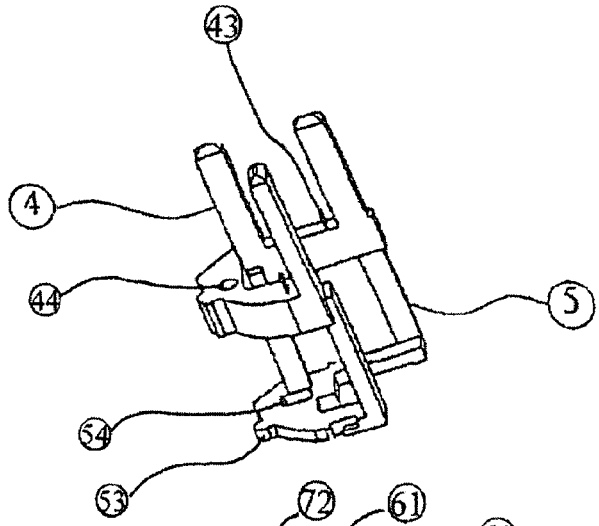
FIG. 12 is a perspective view of the British plug and its carriage of the present invention, showing the final state thereof.
Figure 21:
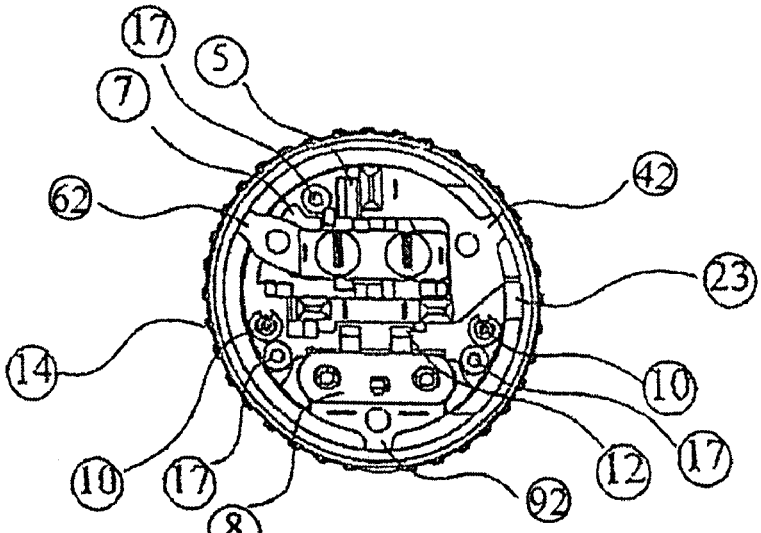
FIGS. 21 and 22 is a top view and a front view of the travel adaptor of the present invention with the upper cover opened, respectively.

As shown in FIGS. 11 and 12, the British plug 4 comprises a bottom part 40, three plug columns 41 extending upward from the bottom part 40 to form the formation of a British plug, and a protrusion 42 stretching out of the bottom part 40 to interfere with the projection 23 of the dial member 14 (see FIG. 21). An aperture 44 is formed through the bottom part 40 of the British plug 4. One of the fixed shafts 16 passes through the aperture 44, to guide the British plug 4 to move up and down along the shaft. The British plug 4 also includes contacts 43 formed on the bottom part 40, which could contact the conductive metal sheet 3 when the British plug 4 has been moved to its operation position.

Figure 25:
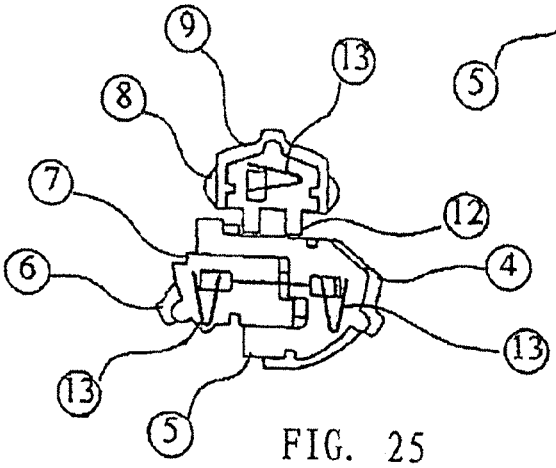
FIG. 25 is a top view illustrating the connection between the inner plugs and the V-shape elastic patch.

The British plug carriage 5 comprises a base part 50, three supporting columns 51 extending upward from the base part 50, and a bulge 53 stretching out of the base part 50 to interfere with the projection 23 of the dial member 14. At the tip of each supporting column 51, a notch 52 is formed, to receive the bottom part 40 of the British plug 4 when the plug has been moved to its operation position. An orifice 54 could be formed through the base part 50 of the British plug carriage 5 for the respective fixed shaft passing through. The British plug carriage 5 is mounted in such a manner that it could be translated on the top surface of the base member 15. A V-shape elastic patch 13 is provided. The V-shape elastic patch 13 has two legs, in which one leg is fixed to the base member 15, and the other leg presses against the British plug carriage 5, to bias the British plug carriage 5 towards the dial member 14 (see FIG. 25).

Figure 13:
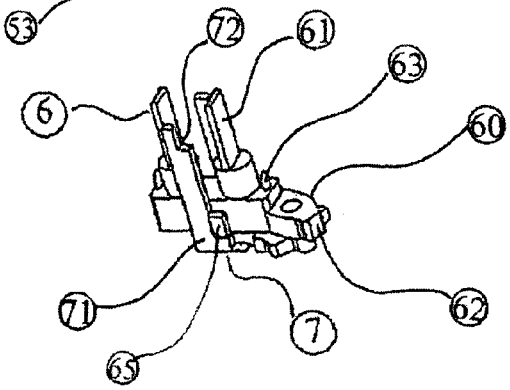
FIG. 13 is a perspective view of the 1-shape plug and its carriage of the present invention, showing the initial state thereof.
Figure 14:
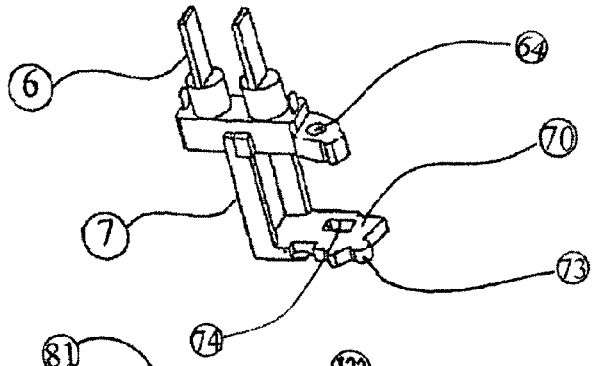
FIG. 14 is a perspective view of the 1-shape plug and its carriage of the present invention, showing the final state thereof.
Figure 19:
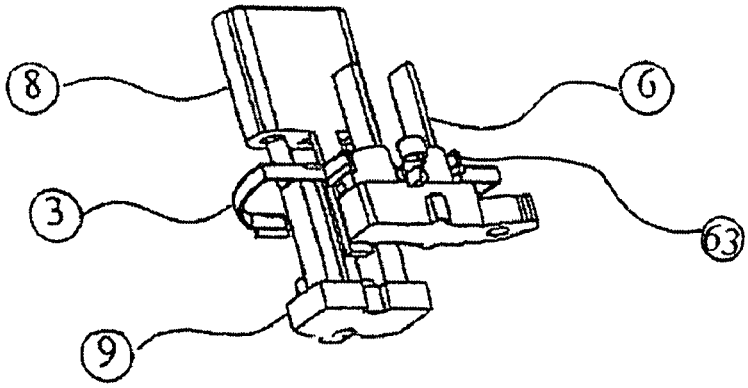
FIG. 19 is a perspective view illustrating the connection between the 1-shape plug and conductive metal sheet of the present invention.

As shown in FIGS. 13 and 14, the 1-shape plug 6 comprises a bottom part 60, two plug columns 61 extending upward from the bottom part 60 to form the formation of a 1-shape plug, and a protrusion 62 stretching out of the bottom part 60 to interfere with the projection 23 of the dial member 14 (see FIG. 21). The 1-shape plug 6 also includes contacts 63 formed on the bottom part 60, which could contact the conductive metal sheet 3 when the 1-shape plug 4 has been moved to its operation position (see FIG. 19). An aperture 64 is formed through the bottom part 60 of the 1-shape plug 6. One of the fixed shafts 16 passes through the aperture 64, to guide the 1-shape plug 6 to move up and down along the shaft. Furthermore, two supporting protrusions 65 are formed on both sides of the bottom part 60 of the 1-shape plug 6.

The 1-shape plug carriage 7 comprises a base part 70, two supporting columns 71 extending upward from the base part 70, and a bulge 73 stretching out of the base part 70 to interfere with the projection 23 of the dial member 14. At the tip of each supporting column 71, a notch 72 is formed, to receive the supporting protrusions 65 of the 1-shape plug 6 when the plug has been moved to its operation position. An orifice 74 could be formed through the base part 70 of the 1-shape plug carriage 7 for the respective fixed shaft passing through. The 1-shape plug carriage 7 is mounted in such a manner that it could be translated on the top surface of the base member 15. A V-shape elastic patch 13 is provided. The V-shape elastic patch 13 has two legs, in which one leg is fixed to the base member 15, and the other leg presses against the 1-shape plug carriage 7, to bias the 1-shape plug carriage 7 towards the dial member 14 (see FIG. 25).

Figure 15:
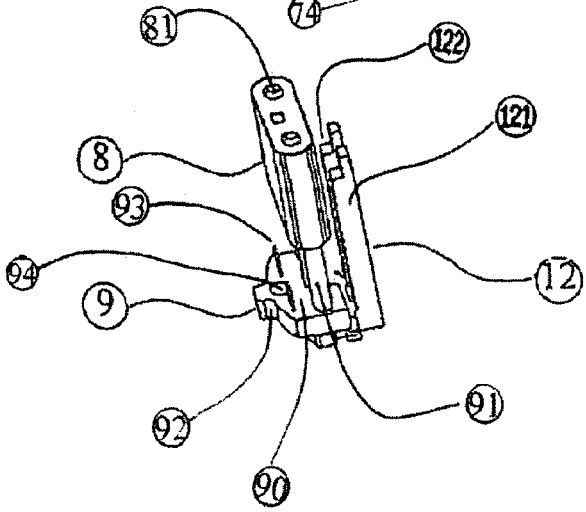
FIG. 15 is a perspective view of the European plug and its carriage of the present invention, showing the initial state thereof.
Figure 16:
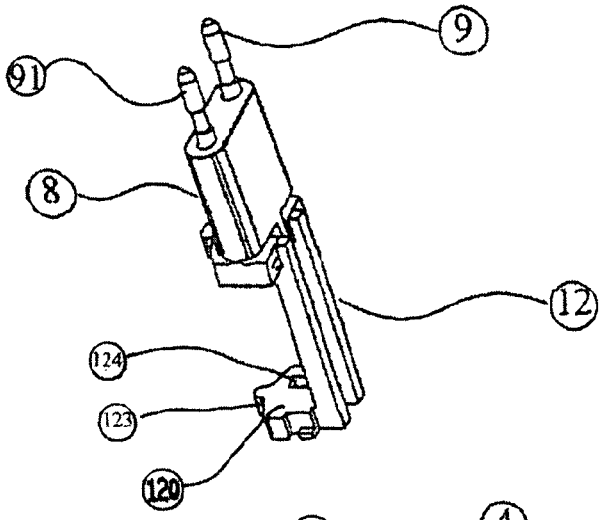
FIG. 16 is a perspective view of the European plug and its carriage of the present invention, showing the final state thereof.

As shown in FIGS. 15 and 16, the European plug 9 comprises a bottom part 90, two plug columns 91 extending upward from the bottom part 90, a protrusion 92 stretching out of the bottom part 90 to interfere with the projection 23 of the dial member 14 (see FIG. 21), and a European plug bracket 8. The European plug bracket 8 has two through holes 81 along its height, which through holes 81 are mounted around the plug columns 91, to form the formation of a European plug. The European plug bracket could be seated on stakes formed on the top end of the base member 15 (see FIG. 20). An aperture 94 is formed through the bottom part 90 of the European plug 9. One of the fixed shafts 16 passes through the aperture 94, to guide the European plug 9 to move up and down along the shaft.

The European plug 9 also includes contacts 93 formed on the bottom part 90, which contacts could contact the conductive metal sheet 3 when the European plug 9 has been moved to its operation position.

The European plug carriage 12 comprises a base part 120, two supporting columns 121 extending upward from the base part 120, and a bulge 123 stretching out of the base part 120 to interfere with the projection 23 of the dial member 14. At the tip of each supporting column 121, a notch 122 is formed, to receive the bottom part 90 of the European plug 9 when the plug has been moved to its operation position. An orifice 124 could be formed through the base part 120 of the European plug carriage 12 for the respective fixed shaft passing through. The European plug carriage 12 is mounted in such a manner that it could be translated on the top surface of the base member 15. A V-shape elastic patch 13 is provided. The V-shape elastic patch 13 has two legs, in which one leg is fixed to the base member 15, and the other leg presses against the European plug carriage 12, to bias the European plug carriage 12 towards the dial member 14 (see FIG. 25).

The upper cover 1 covers the inner plugs and is provided with a plurality of plughole arrays, through which the respective inner plugs could be pushed upwards to their operation position. As an example, FIG. 5 shows that the plughole arrays are combination of a British plughole array 4', a 1-shape plughole array 6' and a European plughole array 9'. Through the British plughole array 4', the British plug 4 could be pushed out to its operation position. Similarly, the 1-shape plug 6 and European plug 8 could be pushed out to their respective operation positions through the 1-shape plughole array 6' and European plughole array 8' respectively, as shown FIG. 2.

Figure 3:
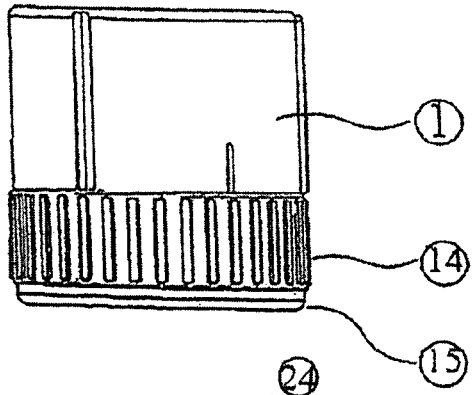
FIGS. 3 to 4 show a front view and a bottom view of the travel adaptor of the present invention, respectively.
Figure 4:
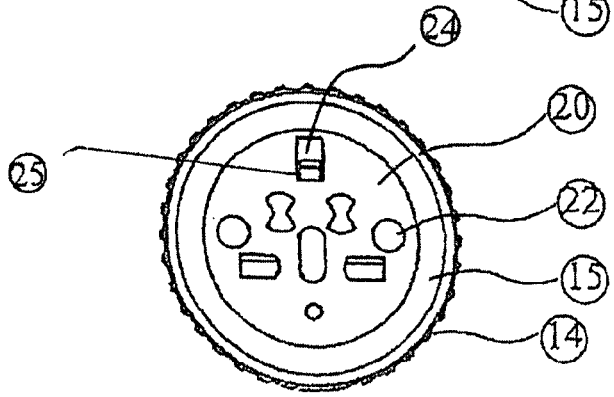

As shown in FIG. 3, the upper cover may have several marks formed on the outside surface thereof, to indicate the rotation position of the dial member 14 around the base member 15 by cooperating with the mark form on the outside surface of the dial member.

The travel adaptor may also comprise a lower cover 20 attaching to the base member 15 from below to cover the socket arrays 24, to avoid the risk of being shocked. A plurality of socket hole arrays 25 are formed on the surface of the cover 20, to correspond to the respective socket arrays 24 (see FIG. 4). The lower cover 20 could be attached to the base member 15 by any means known in this filed. As an example shown in FIG. 1, the lower cover 20 is attached to the base member 15 by screws 21. The screws 21 are further covered by screw caps 22, to further avoid the risk of being shocked.

Figure 6:
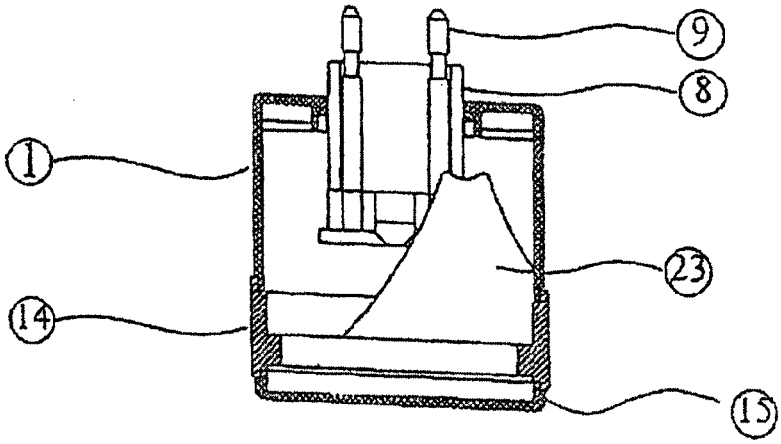
FIGS. 6 to 8 are frontal sectional views of the travel adaptor of the present invention, showing the operation principal of the adaptor.
Figure 7:
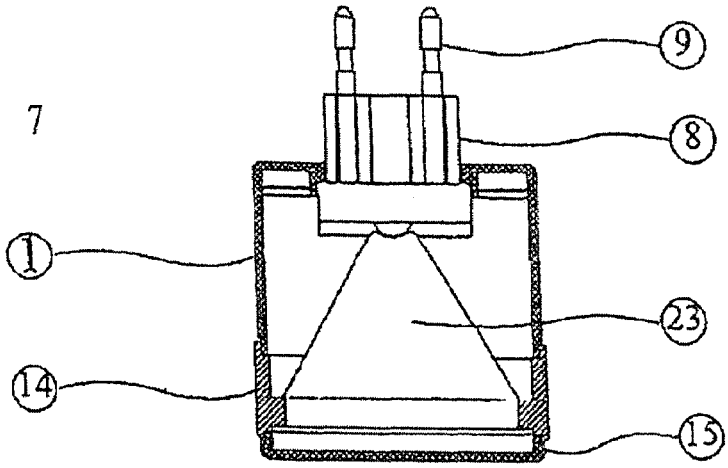
Figure 8:
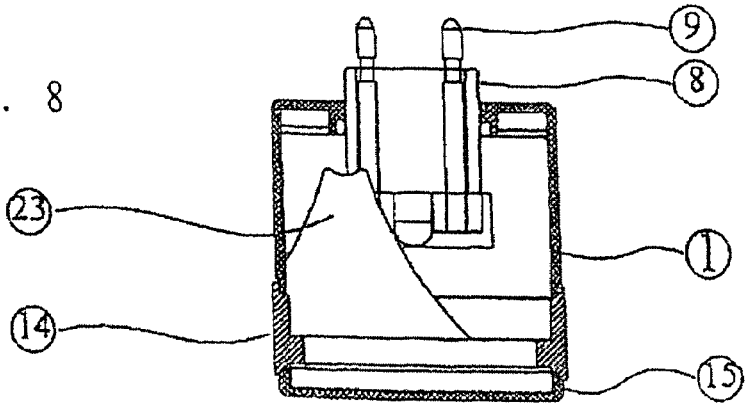

With reference to FIGS. 6-8, the operation of the present travel adaptor will be described in detail by way of example.

At initial stage, the European plug bracket 8 is supported on the stakes 151 of the base member 15 and below the level of the upper cover 1. The European plug 9 is pressed on the base part 120 of European plug carriage 12 by the spring 2.

Then, with the rotation of the dial member 4, the protrusion 92 starts to contact one of the slopes 232 of the projection 23. If the dial member is rotated clockwise (see from above), the protrusion 92 will get in touch with the left side slope, as shown in FIG. 6. If the dial member is rotated counter-clockwise, the protrusion 92 will get in touch with the right side slope (not shown). At the same time, the lower part of the projection 23 starts to press the bulge 123 of the European plug carriage 12, to make the bulge 123 get in touch with the inner surface of the projection 23. Due to the pressure of the projection 23, the European plug carriage 12 is moved inward towards the center of the base member 15, and the V-shape elastic patch 13 is compressed.

When the dial member 4 is further rotated in clockwise direction, the protrusion 92 is driven to move upward along the slope, to move the European plug 9 upward towards the European plug bracket 8. Then, when the bottom part 90 of the European plug 9 contacts the European plug bracket 8, the European plug 9 will be moved upward together with the European plug bracket 8 by means of the continuous rotation of the dial member 4 in clockwise direction.

At last, when the protrusion 92 is driven to the top of the projection 23 and received in the groove 231 of the projection 23, the European plug 9 and the European plug 8 are both pushed out of the upper cover 1, to be positioned in operation position. At that time, the bulge 123 of the European plug carriage 12 will be moved along the inner surface of the projection 23 to be received in the recess 233 formed into the inner surface of the projection 23. Thus, the V-shape elastic patch 13 will force the European plug carriage 12 to move outward towards the dial member 14. Therefore, the European plug carriage 12 will support the European plug 9 by receiving the plug in the notch 122.

When European plug need to retreat back to the inner space of the travel adaptor, the dial member 4 will be rotated in clockwise direction or counter-clockwise direction, and then the protrusion 92 will be moved out of the groove 231, and the bulge 123 will be moved out of the recess 233. Due to the pressure of the inner surface of the projection 23, the European plug carriage 12 will be moved inward towards the center of the base member 15, thus, the notch 122 will release the European plug 9. Then, following the movement of the protrusion 92 along the one of the slopes 232, the European plug 9 will be pressed downward towards the base part 120 of the European plug carriage 12 by means of the compression pressure of the spring 2. The European plug bracket 8 will also retreat into the inner space of the adaptor by virtue of the gravity of itself. At the same time, the bulge 123 of the European plug carriage 12 will move along the inner surface of the projection 23, and finally separates from the projection 23. Then, the projection 23 will release the bulge 123, and the European plug carriage 12 will be moved outwards towards the dial member 14 by virtue of the bias of the V-shape elastic patch 13.

In the similar manner, the British plug 4 and the 1-shape plug 6 could be moved upwards to their operation positions through the respective plughole arrays formed through the upper cover 1 by means of contact between the protrusion of the respective plug and the projection of the dial member, and could be supported by the projection 23 and their respective plug carriages 5 and 7 when they are in their operation position.

Figure 9:
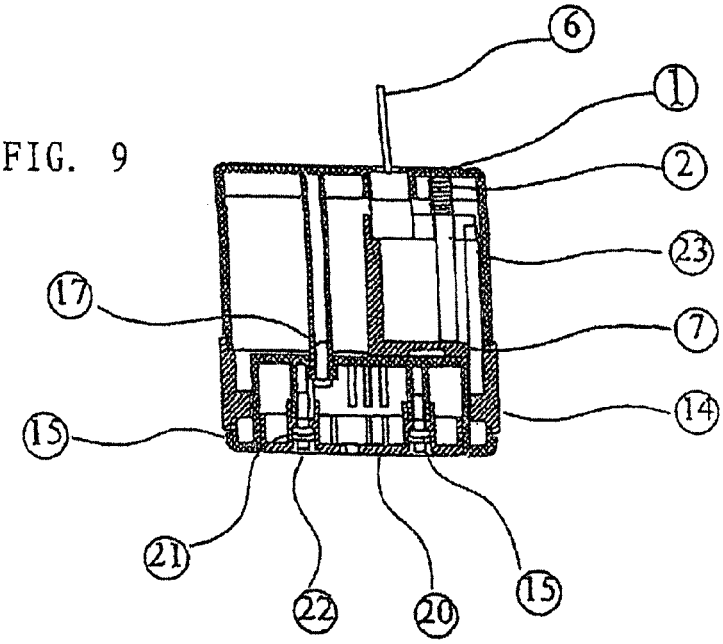
FIGS. 9 and 10 are frontal sectional views of the travel adaptor of present invention, showing different operating states of the spring.
Figure 10:
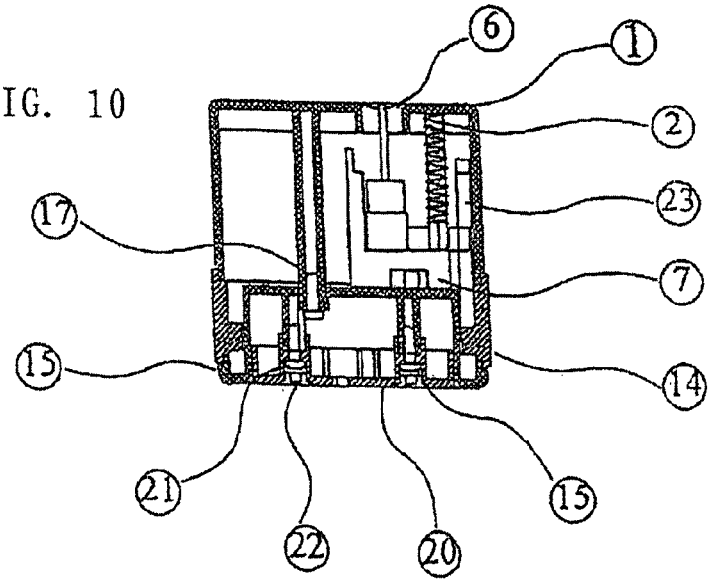

FIGS. 9 and 10 show the operation states of the springs of the present invention by way of example. As shown in FIG. 9, when the 1-shape plug 6 is pushed to the operation position, the spring 2 is compressed. When the 1-shape plug 6 needs to retreat into the inner space of the adaptor, the compressed spring 2 will apply compression pressure on the plug 6 to force it downward towards the base part 70 of the 1-shape plug carriage 7.

Figure 17:
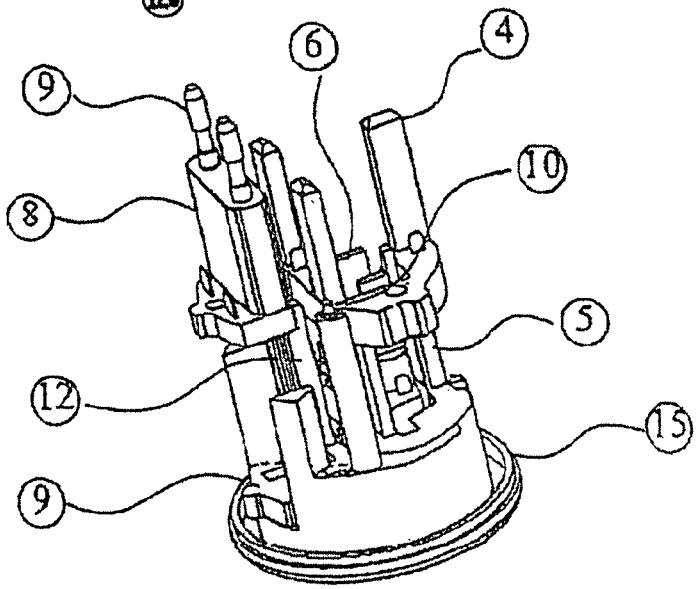
FIG. 17 is a perspective view the travel adaptor of the present invention with the upper cover opened, in which the European plug is in its operation position.
Figure 18:
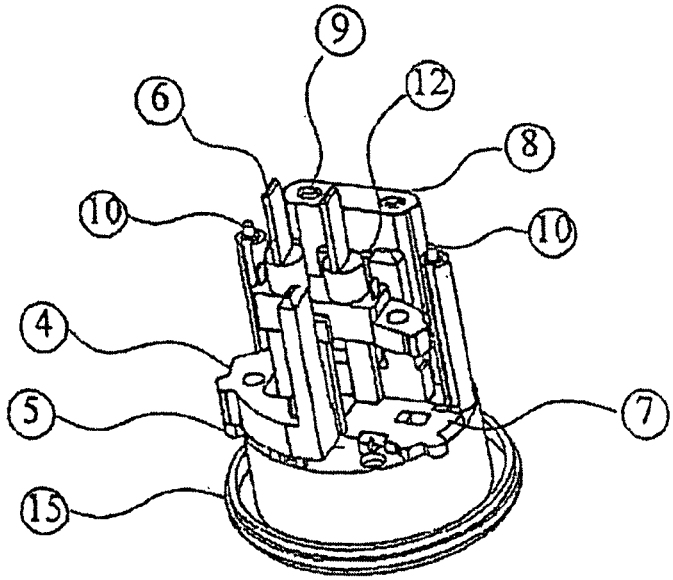
FIG. 18 is a perspective view the travel adaptor of the present invention with the upper cover opened, in which the 1-shape plug is in its operation position.
Figure 23:
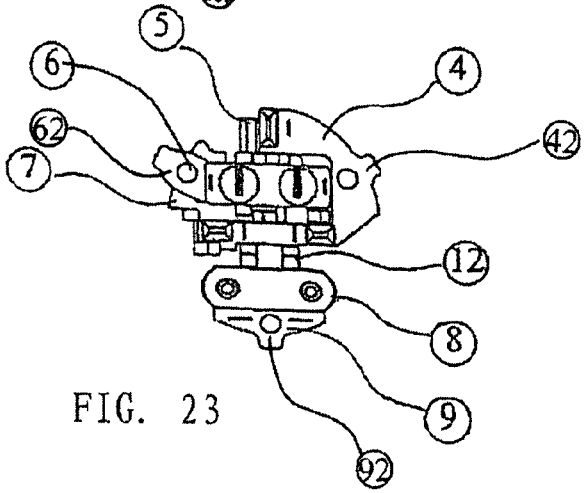
FIGS. 23 and 24 is a top view and a perspective view of the inner plugs of the present invention.
Figure 24:
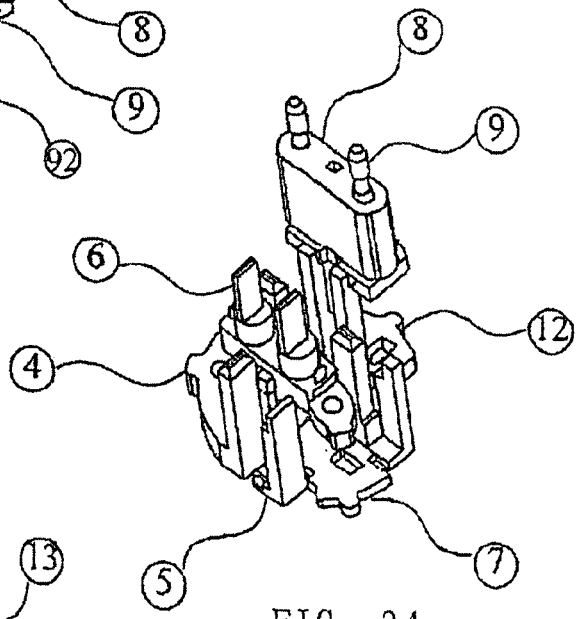

FIGS. 17, 18, 23 and 24 show an example of the arrangement of the inner plugs. As shown in FIG. 23, the included angles between every two adjacent protrusions could be about 120°, however, the included angles could be varied according to the number and size of the inner plugs. As shown in FIGS. 18 and 24, the British plug carriage 5 is adjacent to the European plug carriage 12. In order to make the travel adaptor compact, the 1-shape plug 6 may be disposed in the inner space formed by the three plug columns 41 of the British plug 4, and the base part 70 of the 1-shape plug carriage 7 could be disposed in a notch formed in the base part 50 of the British plug carriage 5, as shown in FIG. 17.

Although the description of the present invention is made with reference to the preferred embodiments, the present invention is not limited to these embodiments. Various modifications and changes can be made to the invention by those skilled in the art without departing from the spirit and scopes of the present invention.

What is claimed is:

1. A versatile travel adaptor, comprising:

a cylindrical base member which is provided with a plurality of fixed shafts extending upward from the top end thereof and a plurality of socket arrays formed into the bottom end thereof;

a dial member which is rotatably mounted around the base member and provided with a projection extending upward between the dial member and the peripheral of the base member;

a plurality of inner plugs each of which is movably mounted above the top end of the base member and guided by the respective fixed shaft to be moved up and down along the fixed shaft; and an upper cover which covers the inner plugs and is provided with a plurality of plughole arrays therethrough;

wherein the socket arrays are provided with conductive sheets electrically connected to the inner plugs and are used to receive outer plugs to be converted, each of the inner plugs has a protrusion laterally extending to interfere with the projection of the dial member, and the dial member could be rotated to select one of said inner plugs at a time and move the selected inner plug upward to its operation position through the respective plughole array by mean of contact between the protrusion of the selected inner plug and the projection of the dial member.

2. The versatile travel adaptor according to claim 1, further comprising:

a plurality of conductive poles fixed to the base member; and a plurality of conductive metal sheets mounted on the top ends of the conductive poles;

wherein said conductive sheets are electrically connected to the bottom end of the conductive poles, and the conductive metal sheets are mounted in such a manner as to eclectically contact the selected inner plug when the inner plug has been moved to its operation position.

3. The versatile travel adaptor according to claim 1, wherein the projection comprises a slope formed on at least one side thereof along the peripheral of the base member for guiding the protrusion of the selected inner plug smoothly, and a groove formed on the top end thereof for receiving the protrusion of the selected inner plug when the selected inner plug is in its operation position.

4. The versatile travel adaptor according to claim 1, wherein the adaptor further comprises a plurality of springs mounted around the fixed shafts between the upper cover and each inner plug, said springs bias the respective inner plugs towards the base member.

5. The versatile travel adaptor according to claim 2, wherein said inner plug comprises a bottom part and a plurality of plug columns extending upward from the bottom part, and said protrusion stretches out of the bottom part to interfere with the projection of the dial member.

6. The versatile travel adaptor according to claim 5, wherein said inner plug comprises an aperture formed through the bottom part thereof through which the respective fixed shaft passes.

7. The versatile travel adaptor according to claim 6, wherein the inner plug comprises a plurality of contacts formed on the bottom part, which contact the conductive metal sheet when the inner plug is in its operation position.

8. The versatile travel adaptor according to claim 1, wherein said inner plugs are any of a British plug, a 1-shape plug and a European plug, or arbitrary combination thereof.

9. The versatile travel adaptor according to claim 8, wherein said inner plugs are combination of a British plug, a 1-shape plug and a European plug.

10. The versatile travel adaptor according to claim 9, wherein the included angle between every two adjacent protrusions of said inner plugs is substantially 120°.

11. The versatile travel adaptor according to claim 10, wherein the 1-shape plug is disposed in the inner space formed within the British plug.

12. The versatile travel adaptor according to claim 1, wherein the adaptor further comprises a plurality of plug carriages to correspond to said plurality of inner plug, in which the plug carriages are translatably mounted on top end of the base member, each of the inner plugs is seated on the respective plug carriage, and the selected inner plug is supported by the respective plug carriage from below when the selected inner plug is in the operation position.

13. The versatile travel adaptor according to claim 12, wherein the adaptor further comprises a plurality of V-shape elastic patch to correspond to said plurality of plug carriages, and each the V-shape elastic patch includes two legs, in which one leg is fixed to the base member and the other leg presses against the respective plug carriage to bias the plug carriage toward the dial member.

14. The versatile travel adaptor according to claim 13, wherein said plug carriage comprise a base part, a plurality of supporting columns extending upward from the base part, and a bulge stretching out of the base part to interfere with the projection of the dial member.

15. The versatile travel adaptor according to claim 14, wherein at the middle portion of the lower part of the projection, a recess is formed into the inner surface of the projection facing to the base member, said recess receives the bulge of the respective plug carriage when the selected inner plug is moved to its operation position.

16. The versatile travel adaptor according to claim 15, wherein a notch is formed at the tip of each supporting columns to receive the respective inner plug when the inner plug has been moved to its operation position.

17. The versatile travel adaptor according to claim 16, wherein the plug carriages are any of a British plug carriage, a 1-shape plug carriage and a European plug, or arbitrary combination thereof.

18. The versatile travel adaptor according to claim 1, wherein the adaptor further comprises a lower cover arranged to cover the socket arrays, and the lower cover is provided with socket hole arrays corresponding to the socket arrays.

* * * * *

UNITED STATES PATENT AND TRADEMARK OFFICE

CERTIFICATE OF CORRECTION

PATENT NO. : 7,381,067 B2
APPLICATION NO. : 11/750939
DATED : June 3, 2008
INVENTOR(S) : Hung To Honton Sze It is certified that error appears in the above-identified patent and that said Letters Patent is hereby corrected as shown below:

On the title page of the patent grant, please replace item (76) inventor's name from "Hug To Honton Sze" to -- Hung To Honton Sze --

Signed and Sealed this
Thirty-first Day of January, 2012

David J. Kappos

David J. Kappos
*Director of the United States Patent and Trademark Office*